US007000362B1

(12) United States Patent
Cullinan

(10) Patent No.: US 7,000,362 B1
(45) Date of Patent: Feb. 21, 2006

(54) SCREENING DEVICE

(76) Inventor: James E. Cullinan, 2737 Welsford Rd., Columbus, OH (US) 43221

( * ) Notice: Subject to any disclaimer, the term of this patent is extended or adjusted under 35 U.S.C. 154(b) by 322 days.

(21) Appl. No.: 10/249,698

(22) Filed: Apr. 30, 2003

Related U.S. Application Data

(60) Provisional application No. 60/376,476, filed on Apr. 30, 2002.

(51) Int. Cl.
*E04B 1/343* (2006.01)
*E04B 1/62* (2006.01)

(52) U.S. Cl. ..... 52/780; 52/507; 52/506.06; 52/656.2; 52/72; 52/656.1

(58) Field of Classification Search ..... 52/770, 52/781, 780, 200, 507, 510, 656.1, 72, 800.12, 52/656.2, 656.7, 506.06
See application file for complete search history.

(56) References Cited

U.S. PATENT DOCUMENTS

| | | | | | |
|---|---|---|---|---|---|
| 1,158,626 | A | * | 11/1915 | Brooks | 52/200 |
| 1,220,219 | A | * | 3/1917 | Goldman | 52/200 |
| 1,460,098 | A | | 6/1923 | Houser | |
| 1,589,560 | A | * | 6/1926 | Reuter | 52/209 |
| 2,177,699 | A | * | 10/1939 | Fisher | 52/236.3 |
| 2,302,047 | A | * | 11/1942 | Olsen | 52/242 |
| 2,817,752 | A | * | 12/1957 | Florence | 362/355 |
| 3,106,269 | A | * | 10/1963 | Revell et al. | 403/295 |
| 3,507,079 | A | * | 4/1970 | George | 52/74 |
| 3,525,560 | A | * | 8/1970 | Mac-Farlane et al. | 312/265.3 |
| 3,606,510 | A | * | 9/1971 | Anderson | 312/265.1 |
| 3,720,432 | A | | 3/1973 | Chudler | 292/220 |
| 3,742,659 | A | | 7/1973 | Drew | 52/19 |
| 3,802,131 | A | * | 4/1974 | Resech | 52/60 |
| 3,890,989 | A | | 6/1975 | Kuxhouse et al. | 135/7.1 R |
| 4,001,985 | A | | 1/1977 | Nikolaus et al. | 52/28 |
| 4,044,518 | A | * | 8/1977 | Hodge | 52/301 |
| 4,179,169 | A | * | 12/1979 | Daniels et al. | 312/265.4 |
| 4,263,763 | A | | 4/1981 | Bouwens | 52/404 |
| 4,488,565 | A | | 12/1984 | Smith | 135/100 |
| 4,498,262 | A | | 2/1985 | Garcia | 52/173 |
| 4,541,208 | A | | 9/1985 | Vesperman et al. | 52/19 |
| 4,550,534 | A | | 11/1985 | Mariano et al. | 52/19 |
| 4,769,965 | A | | 9/1988 | Shaub | 52/488 |
| 4,884,379 | A | * | 12/1989 | McCabe | 52/200 |
| 5,470,139 | A | * | 11/1995 | Hsiao | 312/140 |
| 5,568,707 | A | * | 10/1996 | Ishikawa et al. | 52/200 |

(Continued)

FOREIGN PATENT DOCUMENTS

| | | | | |
|---|---|---|---|---|
| GB | 2043148 | * | 10/1980 | 52/780 |

(Continued)

OTHER PUBLICATIONS

Spinnaker Rooftop Screening System (date unknown but apparently after Apr. 17, 2003).

*Primary Examiner*—Phi Dieu Tran A
(74) *Attorney, Agent, or Firm*—Kremblas, Foster Phillips & Pollick

(57) ABSTRACT

A screening device is provided with multiple channel upper and lower panel retaining members that allow multiple panel members to be slid in front of or behind each other. Channel end caps and close spacing of the upper and lower panel retaining members prevent removal of the panels from the screening device. A support structure uses angled castings and extrusion members for rapid custom screen device assembly that avoids long welding assembly times as well as subsequent weld failure due to screen device vibration. A corner panel, decorative trim, a top panel retaining member alignment tang, and a fastener concealing end cap are also provided.

19 Claims, 4 Drawing Sheets

U.S. PATENT DOCUMENTS 5,647,181 A * 7/1997 Hunts ..... 52/282.1
5,664,384 A 9/1997 Cullinan ..... 52/507
5,797,225 A * 8/1998 Ishikawa ..... 52/93.1
5,997,117 A * 12/1999 Krietzman ..... 312/265.4
6,209,271 B1 * 4/2001 Kovacs ..... 52/200
6,428,127 B1 * 8/2002 Rasmussen ..... 312/265.4
6,647,683 B1 * 11/2003 Thomsen et al. ..... 52/302.1

FOREIGN PATENT DOCUMENTS

GB 2124689 * 2/1984 ..... 52/72
GB 2151462 * 7/1985 ..... 52/656.2

* cited by examiner

SCREENING DEVICE

CROSS REFERENCE TO RELATED APPLICATIONS

This application claims the benefit of U.S. provisional application 60/376,476 filed on Apr. 30, 2002 all of which is incorporated here by reference as if completely written herein.

BACKGROUND OF INVENTION

1. Field

This invention relates to screening devices and related types of apparatus. It has to do primarily with apparatus for screening the view of large outdoor equipment where it is necessary or desirable to improve its appearance in public places. For example, the invention can provide attractive screening for heating, ventilating, and air conditioning equipment on top of business establishments in areas of a city where all outdoor structures are required to have a pleasing appearance. In particular this invention relates to an improved screen device in which sheets are slidably contained within upper and lower tracks and secured within the tracks by permanently attached end caps.

2. Background

As set forth in U.S. Pat. No. 5,664,384, screening apparatus for large equipment can be difficult and time consuming to remove when it is necessary to make repairs or adjustments unless the screening apparatus is constructed and arranged so that it can be moved easily from its normal location around the equipment. In that patent, the screening apparatus was designed so that panels could be moved quickly and easily away from, and back to, their normal screening location by a single person without need for equipment to move the screening apparatus. Unfortunately, it has been found that on occasion severe weather conditions would force the panels from their securing tracks. And even more perversely, it has been found that individuals repairing the screened equipment often removed the panels and then failed to replace them after the repairs had been completed.

In addition to the problem of "lost" panels, members of the framework supporting the panels and the channels in which they were mounted were typically welded together. This of course required extensive and exact setup prior to and during the welding process. Further, due to the vibration of the underlying equipment to which the screen was mounted, welds were found to be subject to breakage with subsequent deleterious consequences to the screen panels.

In order to overcome these problems, it is an object of the present invention to provide a framework that is easy to assemble.

It is another object of the present invention to provide a framework that is adjustable with only a minimum of assembler effort.

It is another object of the present invention to provide a framework that avoids weld breakage.

It is yet another object of the present invention to provide covering panels (sheets) that afford easy access to the underlying machinery.

It is another object of the present invention to provide covering panels that are incapable of being removed from their tracks.

It is another object of the present invention to provide covering panels capable of accepting user indicia.

It is therefore the main purpose of the present invention to provide quick and easy access to the screened unit while preventing loss of the screening sheets and providing an attractive appearance at all other times with an assembly that is easy to assemble and which avoids breakage due to severe machinery vibration. The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

SUMMARY OF INVENTION

These and other objects are met by the present invention or a screening apparatus which comprises two or more panels with each panel having a pair of parallel opposite edges. These panels are held at a predetermined location by means of a holding framework that includes an upper, rigid, elongate and substantially channel shaped top panel retaining member that is held in an upper lengthwise horizontal position. This top panel retaining member has at least two, spaced-apart upper channels that face in a substantially downward direction. The holding framework also includes a lower rigid elongate substantially channel shaped bottom panel retaining member that is held in a lower lengthwise horizontal position. The bottom panel retaining member also has at least two, spaced-apart lower channels that are parallel to and face substantially upward toward the top panel retaining member. The top panel retaining member and the bottom panel retaining member being spaced sufficiently close to each other so as to prevent removal of the panels by moving the panels upward into the upper channels and swinging the lower edge of the panels out of and away from the lower channels. The upper channels formed in the top panel retaining member are spaced apart sufficiently from each other as are the lower channels to allow for unobstructed passage of said panels with respect to each other when the panels are slidably moved, i.e., laterally moved, in the upper and lower channels with respect to each other. That is, the channels provide for sufficient spacing between the panels so that they can be moved past each other in their respective upper and lower channels. End caps are positioned over the ends of either the lower channels or the upper channels or both to prevent the panels from being removed from the upper and lower channels by lateral movement of said panels in the channels. That is, the end caps prevent the removal of the panels by laterally sliding them along and out of the ends of the channels. The use of panels that are laterally slidable under and over each other allows quick and easy access to the underlying machinery that the panels screen while at the same time preventing their inadvertent or malicious removal from the screening device.

The present invention also features a corner supporting structure that is comprised of a vertical corner member that is typically attached to the device to be screened and two lower horizontal members, each with first and second ends, with the horizontal members attached to the vertical corner member at right angles to each other at their first ends. Two vertical angular support members with first and second ends are attached at their lower first ends to the second (distal) ends of the lower horizontal members and at their upper ends to an upper portion of the vertical corner member.

A horizontal corner member is attached at its ends to the second distal ends of the two horizontal members.

The present invention features angular castings that are used to attach the various members of the corner supporting structure to each other. Thus first angled castings are used to attach the ends of a corner horizontal member to the second (outer) ends of the horizontal members that are mounted at right angles to each other. The upper ends of the vertical angular support members are attached to the vertical corner member with second angular castings while the lower ends of the vertical angular support members are attached to the second (distal) end region of the horizontal members with third angular castings. The use of standard extrusions for the horizontal, horizontal corner, and vertical angular support members along with angular castings has the advantage of allowing for a wide variety of custom configuration screening devices. In addition, the use of mechanical fasteners to attach the various extrusion members and castings to each other and to the vertical corner member has the advantage requiring only simple tools for the assembly of the screening device and avoids time consuming setup and clamping operations required when the various corner components are welded to each other. Moreover, the use of mechanical fasteners eliminates welded joint failure caused by screened device vibration.

By attaching the top panel retaining member to the upper portion of the vertical corner member and the bottom panel retaining member to the distal ends of the lower horizontal members, a canted orientation of the panels is produced. That is, the panels are slanted from vertical and slope away from the base of the structure to be screened.

A vertical panel orientation can be achieved by adding two upper horizontal members that are attached to the vertical corner member at right angles to each other. When the top panel retainer member is mounted to the ends of these upper horizontal members and the bottom panel retainer member is mounted to the ends of the lower horizontal members, a vertical panel orientation is achieved. When both upper and lower horizontal members are used, a second vertical member is placed between the outer ends of the upper and lower horizontal members to provide additional structural rigidity.

The present invention also features an alignment tang that projects from the top panel retaining member and engages the top end of the vertical corner member. The alignment tang has the advantage of allowing rapid positioning of the top panel retaining member and serves as a "second hand" while the top panel retaining member is fastened to the vertical corner member.

The present invention also features an elongate trim member that can be fastened directly to the top panel retaining member or by means of an attachment bracket. The attachment bracket has the advantage of allowing the trim member to extend further outward from the top panel retaining member thereby affording a longer downward extent to better conceal the top panel retaining member when a canted panel assembly is used.

A corner panel (sheet) is used to cover the corner supporting structure and is typically attached to the vertical angular support members by bending the edges of the corner panel to align with the edge surface of the vertical angular support members. The bottom edge of the corner panel can also be bent to align with the edge surface of the horizontal corner member and attached to the corner member with fasteners such as screws.

The end cap can be formed to cover the ends of both the upper and lower channels. By bending the end cap at right angles to the end surface (parallel to the top and bottom panel retainer members) and then again at a right angle away from the panel retainer members, the end cap can be fastened to the side of the vertical angular support member. The appropriate panel is slid out of the way while the end cap is fastened to the support member. On returning the panel to its closed position, the fastening screens are hidden from view. In addition, such an end cap arrangement has the advantage of concealing the fasteners used to attach the corner panel to the vertical angular support members.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 1:
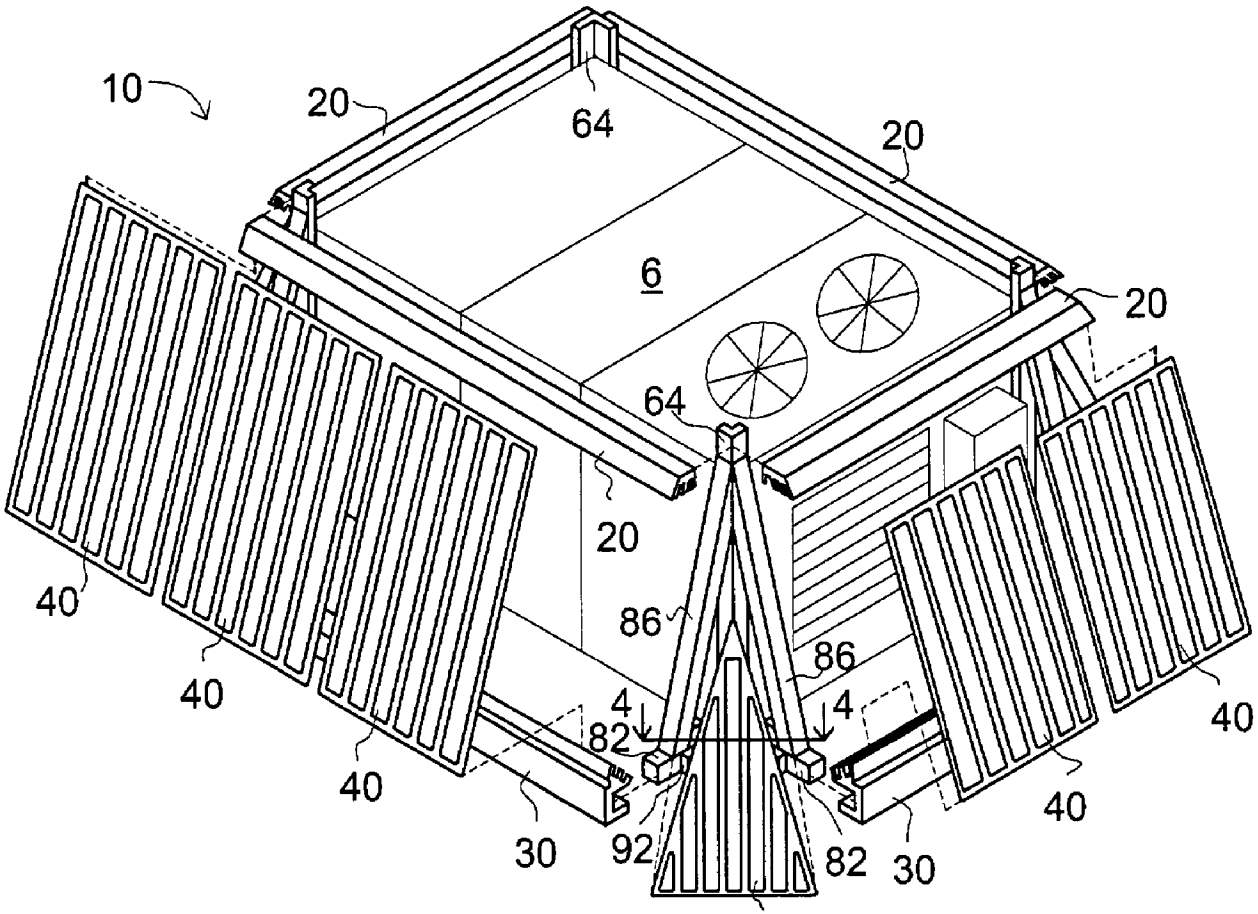
FIG. 1 is an exploded perspective view of the screening device of the present invention illustrating the major components of the system as used with a device such as an air conditioning unit including the upper and lower elongate members (upper and lower panel retaining members), rectangular sheets (panels), corner sheet (panel), and supporting frame structure.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention except as the same may be necessarily modified by the appended claims or reasonable equivalents thereof.

DETAILED DESCRIPTION

As shown initially if FIG. 1, the present invention is a screening device generally designated by the numeral 10 that is used to improve the appearance of large outdoor equipment 6 such as heating, ventilating, and air conditioning equipment. In its basic form, the invention comprises a top elongate panel retaining member 20, a bottom panel retaining member 30, sheets 40 with parallel opposite edges, and end caps 50 (shown in FIG. 4) that prevent the sheets 40 from being removed from the panel retaining members 20 and 30.

Figure 2:
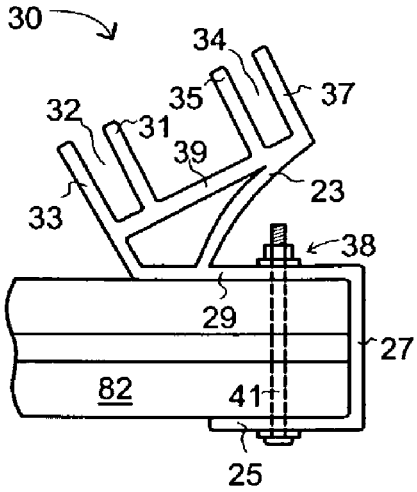
FIG. 2 is an end view of the bottom panel retainer mounted to a horizontal extrusion member.

As shown in FIG. 1 and in further detail in FIG. 2, the bottom panel retainer 30 is comprised of two, spaced-apart, upward directed, U-shaped channels 32 and 34 which receive the lower edges of panels 40. The U-shaped channels 32, 34 are spaced apart sufficiently so that panels 40, which are typically ribbed for structural strength, may slidably move past each other when the lower edge of separate panels 40 are placed in channels 32, 34. Typically and as shown in FIG. 2, the bottom panel retaining member 30 is an extruded member formed with an angled base 39 and orthogonal upward projecting fingers 31, 33, 35, and 37. Finger sets 31, 33 and 35, 37 along with a portion of angled base 39 form U-shaped channels 32 and 34. Base 39 is attached to finger 33 which is an upwardly angled portion of horizontal C-section member 29. Although not essential and other configurations are possible, a rib 23 is used to provide structural rigidity and to support the base 39 of the U-shaped channels 32, 34. The C-section portion of extrusion 30 is formed from contiguous orthogonal members 25, 27, and 29 and is sized to engage the end of horizontal member 82. After engagement of the C-section portion of bottom panel retainer 30 to horizontal member 82, it is secured to horizontal member 82 by means of suitable fastener such a machine screws, tapping screws or nuts and bolts. For example, a nut and bolt assembly 38 may be used in a vertical hole formed in C-section portions 25, 29 and the end of horizontal member 82. Typically both end portions of bottom retaining member 30 are engaged to the ends of horizontal members 82. However, when the length of the bottom retaining member is particularly long, additional horizontal members 82 may be used along the length of bottom panel retainer 30. Although screw-type fasteners are typically used to secure the bottom retainer panel 30, a quick release, clevis-type pin may also be used to secure panel retainer 30 to horizontal members 82. Such quick-release pins enable the quick and easy removal of the bottom panel retainer 30, when unencumbered access to the underlying machinery 6 is frequently required.

As noted, separate panels 40 are mounted in the two U-shaped channels 32 and 34 to allow the panels to slide past each other in channels 32, 34. For ribbed panels 40, the spacing between channels 32 and 34 is considerable to allow for unobstructed passage of the panels 40 behind or in front of each other. As such, separate fingers 31 and 35 have considerable separation between them. However, it is to be realized that fingers 31 and 35 may be formed as a single central finger when the clearance separation between panels 40 is sufficiently small.

Figure 3:
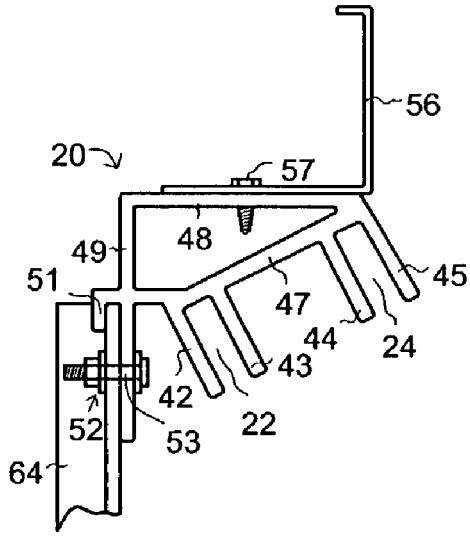
FIG. 3 is an end view of the top panel retainer mounted to a vertical corner member along with an upper trim member.

Similarly and as shown in FIGS. 1 and 3, the top panel retainer 20 is also formed with two, spaced-apart, downward directed, U-shaped channels 22 and 24 which receive the upper edges of panels 40. As with the bottom panel retainer 30, the upper U-shaped channels are spaced apart sufficiently to allow panels 40 mounted in channels 22 and 24 to slide past each other. Preferably the top panel retainer 20 is an extrusion formed from a horizontal top section 48 and a vertical section 49 orthogonally joined at their ends. An angled top member 47 is joined to the opposite end of top section 48 and to the vertical section 49. Fingers 42, 43, 44, and 45 project downward orthogonally from top member 47 to form channels 22 and 24 that receive the upper edges of panels 40. Channels 22 and 24 are spaced sufficiently far apart so as to allow panels 40 to pass in front of or behind each other. Fingers 43 and 44 may be formed as a single finger. An optional tang 51 projects outward from vertical section 49 and then orthogonally downward. The channel formed between tang 51 and vertical section 49 received the upper edge of corner member 64 and allows for rapid positioning of the top panel retainer with respect to corner member 64. The top panel retainer 20 is attached at each end to corner member 64 with a suitable fastener such as a nut and bolt assembly 52 (FIG. 3). When top panel retainer 20 is particularly long, additional pieces of flat members may be used along the length of retainer 20 (not shown).

The bottom panel retainer 30 and the upper panel retainer 20 are spaced apart from each other so as to securely hold the panels 40 in place. That is, panels 40 cannot be removed from the U-shaped channels 22, 24, 32, 34 by moving the panels upward in channels 22 or 24 and swinging the lower edge of panel 40 from channel 32 or 34. In effect the spacing between the bottom panel retainer 30 and the upper panel retainer 20 is such that panels 40 can only be loaded and removed from the open ends of channels 22, 24, 32, and 34.

When end caps 50 are secured to both ends of bottom panel retainer 30 and upper panel retainer 20, panels 40 are securely retained within the channels 22, 24, 32, and 34 and are incapable of being removed from the channels. Although end cap 50 is typically formed as a single piece that covers the ends of bottom panel retainer 30 and upper panel retainer 20, it is to be realized that end cap 50 can be comprised of two or more members that block the ends of channels 22, 24, 32, and 34 and retain panels 40 within these channels. End caps 50, shown in FIG. 4 in cross section, extend along and are fastened to vertical angular support members 86 to close the channel ends of both the upper retainer 20 and lower panel retainer 30. Although only shown with regard to the channel ends of channels 32, 34 of lower panel retainer 30, it is to be realized that the upper portion of single end cap piece 50 also closes the ends of the channels 22, 24 of the upper panel retainer 20.

Figure 4:
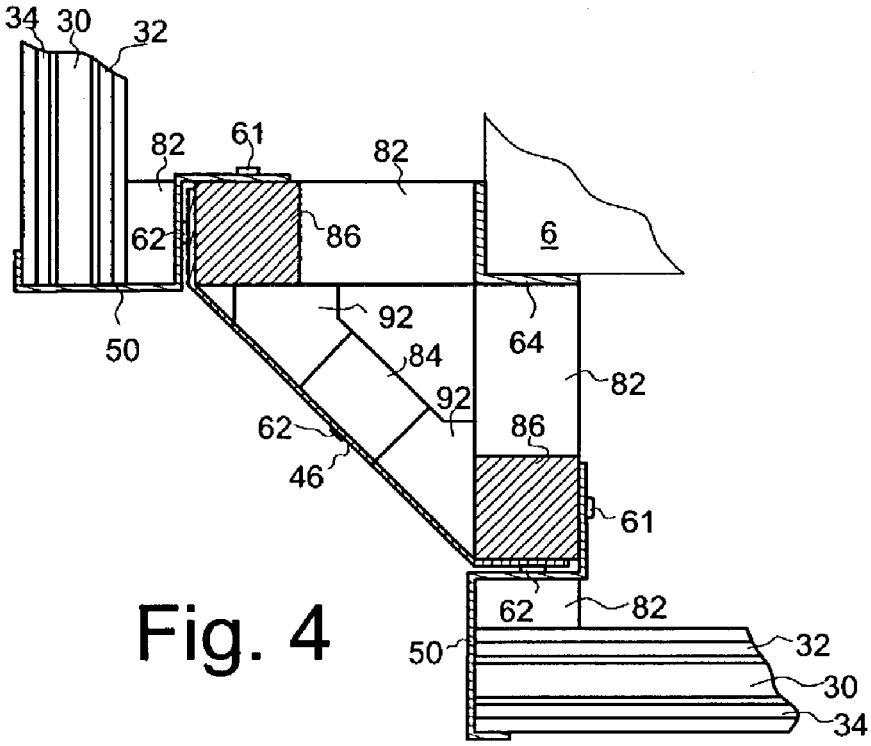
FIG. 4 is a top cross-sectional view along line 4—4 of FIG. 1 illustrating the positioning of end caps at the ends of the bottom panel retainers and the attachment of the end caps to the angular vertical support member so as to conceal the fasteners used to secure the end caps and the corner sheet to the vertical angular support members.
Figure 5:
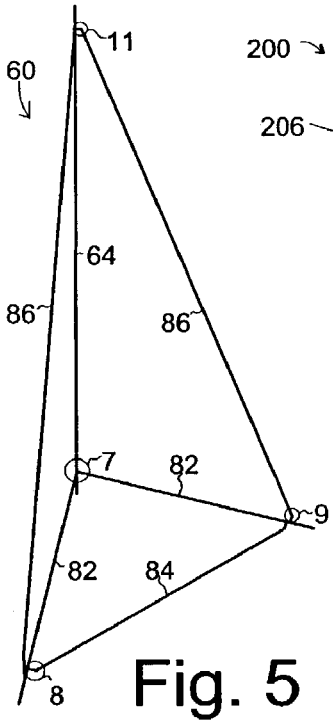
FIG. 5 is a schematic perspective view of the corner framing structure illustrating the location of the angular castings (indicated by numbered circles) used to fasten the various framing members into a corner framing structure.
Figure 7:
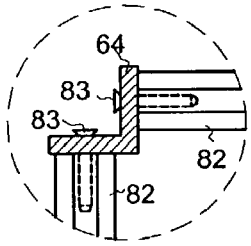
FIG. 7 is a detailed partial top view of the circled portion 7 of FIG. 5 illustrating the fastening assembly used to attach the ends of the horizontal extrusion members to the vertical corner member.
Figure 11:
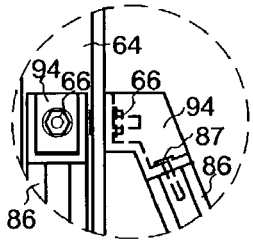
FIG. 11 is a detailed partial plan view of the circled portion 11 of FIG. 5 illustrating the attachment of the vertical angular support extrusion member to the vertical corner member using a third angular casting.

With reference to FIGS. 4, 5 and 7, and initially FIG. 7, the ends of two horizontal members 82 are attached to vertical corner member 64 using a suitable faster such as a bolt or metal screw 83. The ends of bottom retainer channel 30 are attached to the opposite second ends of horizontal members 82 by means of suitable fasteners such as the nut and bolt assembly 38 illustrated in FIG. 2. As further illustrated in FIGS. 4, 5, and 8, a horizontal corner member 84 is also attached near the second ends of horizontal members 82 by means of angular castings 92. The lower ends of vertical support members 86 are also attached near the second ends of horizontal members 82 and at their top to the upper portion of vertical corner member 64 as shown in FIG. 1. FIGS. 5 and 11 illustrate the use of second angular castings 94 to attach the vertical angular support members 86 to the vertical corner member 64 while FIGS. 5 and 9 further illustrate the use of third angular casting 96 to attach the lower ends of vertical angular support member 86 to horizontal extrusion member 82.

Referring to FIG. 4, the vertical edges of corner sheet 46 are bent at an angle for attachment to vertical angular support members 86 by means of fasteners such as metal screws 62. Similarly the base edge of corner sheet 46 is bent for attachment to horizontal corner member 84 with screws 62. After the corner sheet 46 has been secured to the vertical and corner support members 82, 84, the corner cap 50 is placed over the ends of the top and bottom panel retainers 20 and 30. Only the capping of the channels 32, 34 of bottom panel retainer 30 is illustrated in FIG. 4, it being realized that a single end cap 50 extends upward along vertical angular support member 86 to also cap the channels 22, 24 of top panel retainer 20. As shown in FIG. 4, end cap 50 is bent at right angles around two sides of vertical support member 86 and is attached to vertical support member 86 on the inside of the vertical support member 86, it being realized that one of the rectangular sheets 40 is slid out of the way in upper and lower channel pairs 24, 34 or 22, 32 during the attaching process. Such an end capping means has the advantage of concealing all fasteners from view and lessens the possibility of unwanted removal.

Figure 12:
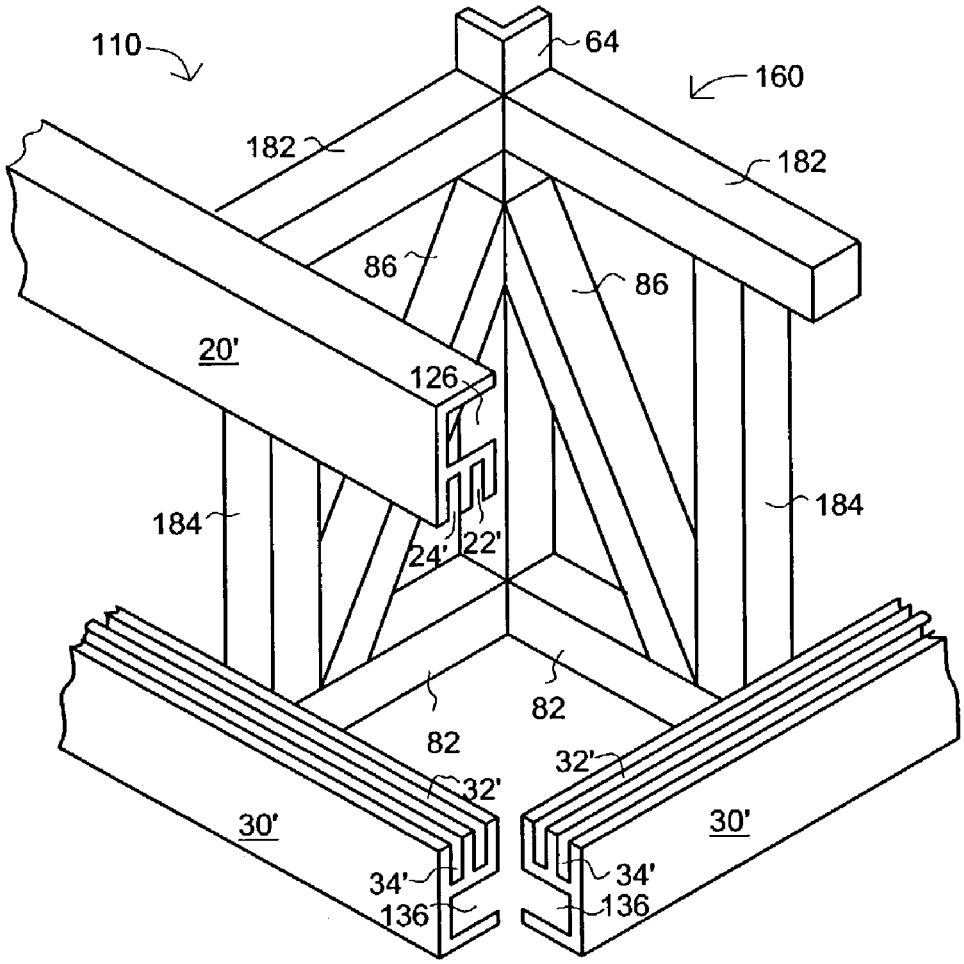
FIG. 12 is a partial perspective drawing of a second embodiment of the invention illustrating the use of vertical upper and lower panel retention members with the upper retention member being supported by additional upper horizontal extrusion members in the supporting structure.

As shown especially in FIGS. 1–3, the upper and lower panel retainers 20 and 30 are formed in such a fashion as to position the panels 40 at an angle to vertical, that is, the panels 40 slope downward away from the device being covered, i.e., a canted configuration. FIG. 12 is a partial perspective view illustrating upper and lower panel retainers 20' and 30' that allow for vertical mounting of panels 40. As illustrated, spaced-apart U-shaped channels 22', 24', 32' and 34' are open so as to provide a vertical panel orientation.

Figure 6:
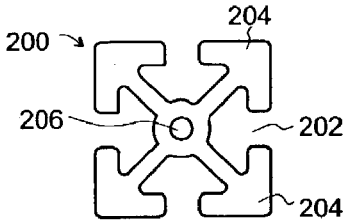
FIG. 6 is an end view of a framing extrusion used in the manufacture of the various frame support members.
Figure 10:
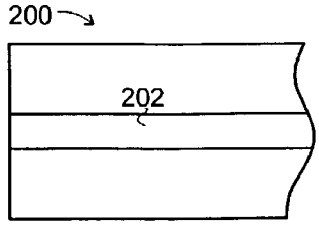
FIG. 10 is a partial plan view of the framing extrusion illustrated in FIG. 5 and used in the manufacture of the various frame support members.

As seen in FIGS. 1 and 4, the top and bottom panel retainers 20 and 30, panels 40, corner panels 46, and end caps 50 (FIG. 4), are supported by means of a supporting structure 60 (FIG. 5) comprised of vertical corner member 64, horizontal extrusion members 82, horizontal corner extrusion member 84, and vertical angular support extrusion members 86. A typical extrusion member 200 is shown in FIGS. 6 and 10 and comprises a central tube in which is formed center bore 206. Exterior corner arms 204 form a partially covered groove 202 on each side of the square-shaped extrusion 200. Angular castings 92, 94, and 96 are shown in FIGS. 4, 5, 8, 9, and 11 and are used to join extrusion members 82, 84, and 86 to each other and to vertical corner member 64.

Referring to FIG. 7 (a top cross-section view of corner assembly 7 in FIG. 5), two horizontal extrusions 82 are attached at right angles to each other by attaching their ends to vertical corner member 64. The horizontal extrusions 82 are attached by screws 83 that pass through the orthogonal portions of corner member 64 into the center cylindrical bore 206 (FIG. 6) of the horizontal extrusion 82.

Figure 9:
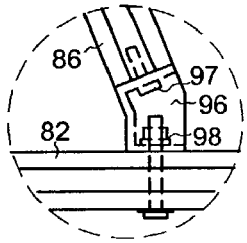
FIG. 9 is a detailed partial plan view of the circled portion 9 of FIG. 5 illustrating the attachment of the angular support extrusion member to the horizontal extrusion member using a second angular casting.

As shown in FIG. 9, a vertical angular support extrusion member 86 is attached at one end to horizontal extrusion member 82 by means of angular casting 96. One end of angular casting 96 is attached to the angular support extrusion member 86 by means of a screw 97 driven into the bore 200 (FIG. 6) of extrusion 86. The other end of angular casting 96 is attached to horizontal extrusion member 82 by means of a nut and bolt assembly 98 passing through a hole drilled into horizontal extrusion member 82. As shown in FIG. 11, the opposite end of angular extrusion 86 is attached to the vertical corner member 64 by means of second angular casting 94. One end of casting 94 is attached to the vertical corner member 64 by means of nut and bolt assembly 66 while the other end of casting 94 is secured to the upper end of vertical angular extrusion 86 by means of a screw 87 that passes through a hole in casting 94 and then is screwed into the bore 200 (FIG. 6) of angular extrusion 86.

Figure 8:
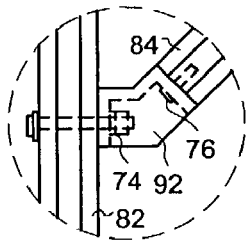
FIG. 8 is a detailed partial top view of the circled portion 8 of FIG. 5 illustrating the attachment of the angled horizontal corner extrusion member to the horizontal extrusion member using a first angular casting.

As shown in FIG. 8, the horizontal corner extrusion member 84 is fastened to the horizontal extrusion member 82 by means of first angular casting 92. One end of angular casting 92 is attached to horizontal extrusion member 82 by means of nut and bolt assembly 74 while the other end of casting 92 is attached to corner extrusion member 84 by means of a screw 76 passing through a hole in the end of casting 92 and screwed into the bore 200 (FIG. 6) of extrusion member 84. The opposite end of extrusion member 84 is similarly attached to a second horizontal member 82 using a second corner casting 92 (FIG. 5).

Referring to FIGS. 1 and 4, the vertical corner member 64 is attached to the screened device 6 by means of screws or other suitable securing means. Preferably the vertical corner member 64 extends slightly above the screened device 6 to enable easy attachment of top panel retainer 20 (FIG. 3) by means of nut and bolt assembly 52. An engagement tang 51 allows for quick alignment and positioning of retainer 20 during the attaching process. As seen in FIG. 2, the bottom panel retainer 30 is attached to the horizontal extrusion members 82 by means of a C-shaped channel formed by retainer 20 members 25, 27, and 29 that accepts the end of horizontal extrusion member 82 and is secured to the extrusion member 82 by means of nut and bolt assembly 38. Alternatively and as shown in U.S. Pat. No. 5,664,384, all of which is incorporated herein as if completely written herein, the screening device 10 may be attached to free standing posts or other alternative anchoring devices.

To complete the screening device 10, a corner panel 46 (FIGS. 1 and 4) is attached to vertical angular corner support extrusion members 86 and horizontal corner extrusion 84, typically with suitable fasteners such as screws 62. The corner panel 46 is attached under a side wall of end caps 50 (FIG. 4) to allow removal and replacement of the end caps 50 in the event one or more of the panels 40 require replacement. Although panels 40 are typically made of plastic or light weight metal such as aluminum, fabric may be used, especially fabric onto which aesthetically pleasing senses of company logos and other indicia may be imprinted.

Figure 13:
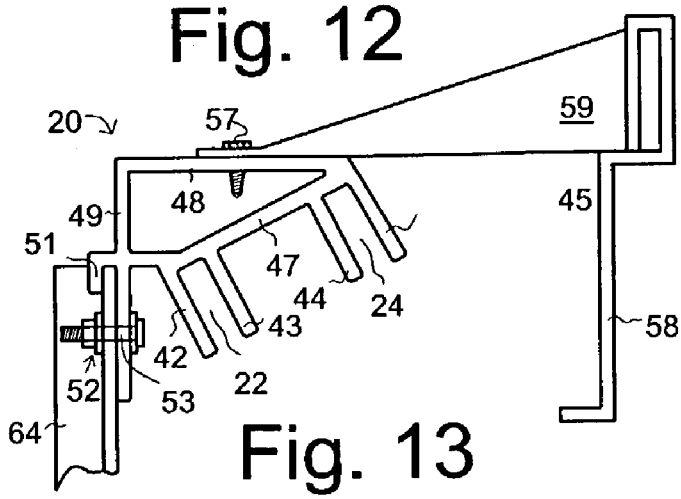
FIG. 13 is an end view of an alternate embodiment of an upper, double-step, elongate trim member attached to the top panel retainer using attachment brackets.

The screening device 10 is typically completed by attaching an upper trim panel 56 (FIG. 3) directly to the top panel retainer 20. Alternatively and as shown in FIG. 13, a double-step, upper trim panel 58 may be mounted outward from the top panel retainer 20 by means of attaching members such as attachment brackets 59 which are mounted to the top of retainer 20 with suitable fasteners such as sheet metal screws 57.

FIG. 12 illustrates an alternative embodiment 110 of the present invention in which the top panel retainer 20' and the bottom panel retainer 30' are formed with spaced-apart U-channels 22', 24', 32', and 34' that have a vertical orientation to afford vertically aligned panels rather than the canted alignment of embodiment 10. The supporting structure 160 is identical to that used with the canted orientation except that it further comprises two upper horizontal extruded members 182 fastened at right angles to each other with one end attached to the vertical corner member 64 in a fashion similar to the attachment of the lower horizontal members 82 as shown in FIG. 7. Vertical extrusion members 184 are attached directly to the upper horizontal extrusion members 182 and the lower horizontal extrusion members 82 by means of a screw passing through a hole formed and passing through extrusion members 182 and 82 and through which a screw is threaded into the center bore 200 (FIG. 5) of the vertical extrusion member 184. The top panel retainer 20' and the lower panel retainer 30' are attached to the ends of the horizontal extrusion members 82 and 182 by means of C-section channels 126 and 136 into which the ends of the horizontal extrusion members 82 and 182 are inserted and secured with suitable fastening devices.

It is possible that changes in configurations to other than those shown could be used but that which is shown is preferred and typical. Without departing from the spirit of this invention, various means of fastening the components together may be used. It is therefore understood that although the present invention has been specifically disclosed with the preferred embodiment and examples, modifications to the design concerning sizing, shape, attachment, and structural reinforcement will be apparent to those skilled in the art and such modifications and variations are considered to be equivalent to and within the scope of the disclosed invention and the appended claims.

What is claimed is:

1. A screening apparatus comprising:

a) at least two panels, each having a pair of parallel opposite edges; and b) means for holding said panels at a predetermined location;

c) said holding means comprising a framework including:

1) an upper rigid elongate substantially channel shaped top panel retaining member held in an upper lengthwise horizontal position with at least two, spaced-apart upper channels facing substantially downward;

2) a lower rigid elongate substantially channel shaped bottom panel retaining member held in a lower lengthwise horizontal position with at least two, spaced-apart lower channels being parallel to, and facing substantially upward toward said top panel retaining member;

3) said top panel retaining member and said bottom panel retaining member being spaced from each other so as to prevent removal of said panels by moving said panels upward in said upper channels and swinging a lower edge of said panels away from said lower channels;

4) said upper channels spaced apart sufficiently from each other and said lower channels spaced apart sufficiently from each other to allow for unobstructed passage of said panels with respect to each other on slidable lateral movement of said panels in said spaced-apart upper and lower channels; and 5) end caps positioned over the ends of at least one of 1) said spaced-apart upper channels and 2) said spaced-apart lower channels to prevent said panels from being removed from said upper channels and said lower channels by lateral movement of said panels in said upper and lower channels; and d) a corner supporting structure with said corner supporting structure further comprising:

1) a vertical corner member;

2) two lower horizontal members, each with first and second ends, with said horizontal members attached at right angles to each other at their first ends to a lower portion of said vertical corner member;

3) two vertical angular support members, each with first and second ends, with said vertical angular support members attached at their lower first ends to said second ends of said horizontal members and at their upper ends to an upper portion of said vertical corner member; and 4) a horizontal corner member attached at its ends to said second ends of said horizontal members.

2. The screening device according to claim 1 wherein said horizontal corner member is attached to said horizontal members by means of first angular castings.

3. The screening device according to claim 1 wherein said vertical angular support members are attached at their upper ends to said vertical corner member with second angular castings.

4. The screening device according to claim 1 wherein said vertical angular support members are attached at their lower ends to said horizontal members with third angular castings.

5. The screening device according to claim 1 wherein said bottom panel retaining member is attached to said second end of one of said horizontal members.

6. The screening device according to claim 1 wherein said top panel retaining member is attached to an upper portion of said vertical corner member.

7. The screening device according to claim 6 wherein said top panel retaining member further comprising an engagement tang for positioning said top panel retaining member with respect to said vertical corner member.

8. The screening device according to claim 1 wherein said panels are aligned in a canted configuration.

9. The screening device according to claim 1 wherein said panels are aligned in a vertical configuration.

10. The screening device according to claim 1 further comprising two upper horizontal members, each with first and second ends, with said upper horizontal members attached at right angles to each other at their first ends to an upper portion of said vertical corner member.

11. The screening device according to claim 10 further comprising a vertical member attached to said second ends of said lower and upper horizontal members.

12. The screening device according to claim 11 with said top panel retaining member attached to said second end of one of said upper horizontal members.

13. The screening device according to claim 1 further comprising an elongate trim member attached to said top panel retaining member.

14. The screening device according to claim 1 further comprising an attachment bracket for attaching said elongate trim member to said top panel retaining member.

15. The screening device according to claim 1 further comprising a corner sheet attached to said vertical angular support members.

16. The screening device according to claim 1 wherein said end caps are attached to said vertical angular support members.

17. A screening apparatus comprising:

a) at least two panels, each having a pair of parallel opposite edges; and b) means for holding said panels at a predetermined location;

c) said holding means comprising a framework including:

1) an upper rigid elongate top panel retaining member held in an upper lengthwise horizontal position facing substantially downward;

2) a lower rigid elongate bottom panel retaining member held in a lower lengthwise horizontal position and being parallel to and facing substantially upward toward said upper rigid elongate top panel retaining member;

3) said upper rigid elongate top panel retaining member and said lower rigid elongate bottom panel retaining member being spaced from each other so as to prevent removal of said panels by moving said panels upward and swinging a lower edge of said panels away from wherein said panels are retained by said upper rigid elongate top panel retaining member and said lower rigid elongate bottom panel retaining member by means of upper channels and lower channels;

4) said upper rigid elongate top panel retaining member and said lower rigid elongate bottom panel retaining member allowing for unobstructed passage of said panels with respect to each other on slidable lateral movement of said panels with respect to said upper rigid elongate top panel retaining member and said lower rigid elongate bottom panel retaining member; and 5) end caps positioned over the ends of at least one of 1) said upper rigid elongate top panel retaining member and 2) said lower rigid elongate bottom panel retaining member to prevent said panels from being removed from said upper rigid elongate top panel retaining member and said lower rigid elongate bottom panel retaining member by lateral movement of said panels with respect to said upper rigid elongate top panel retaining member and said lower rigid elongate bottom panel retaining member; and d) a corner supporting structure with said corner supporting structure further comprising:

1) a vertical corner member;

2) two lower horizontal members, each with first and second ends, with said horizontal members attached at right angles to each other at their first ends to a lower portion of said vertical corner member;

3) two vertical angular support members, each with first and second ends, with said vertical angular support members attached at their lower first ends to said second ends of said horizontal members and at their upper ends to an upper portion of said vertical corner member; and 4) a horizontal corner member attached at its ends to said second ends of said horizontal members.

18. The screening device according to claim 17 wherein said panels are aligned in a canted configuration.

19. The screening device according to claim 17 wherein said panels are aligned in a vertical configuration.

* * * * *